US008904829B2

(12) United States Patent
Keitch

(10) Patent No.: US 8,904,829 B2
(45) Date of Patent: Dec. 9, 2014

(54) KNITTED FABRIC

(75) Inventor: George Keitch, Taunton (GB)

(73) Assignee: Heathcoat Fabrics Limited, Tiverton (GB)

( * ) Notice: Subject to any disclaimer, the term of this patent is extended or adjusted under 35 U.S.C. 154(b) by 64 days.

(21) Appl. No.: 13/138,996

(22) PCT Filed: May 19, 2010

(86) PCT No.: PCT/GB2010/050815

§ 371 (c)(1),
(2), (4) Date: Nov. 10, 2011

(87) PCT Pub. No.: WO2010/133877

PCT Pub. Date: Nov. 25, 2010

(65) Prior Publication Data

US 2012/0055201 A1 Mar. 8, 2012

(30) Foreign Application Priority Data

May 21, 2009 (GB) ..... 0908789.1

(51) Int. Cl.
*D04B 21/16* (2006.01)

(52) U.S. Cl.
CPC ..... *D04B 21/16* (2013.01); *D10B 2505/124* (2013.01); *D10B 2403/0112* (2013.01); *D10B 2403/022* (2013.01)
USPC ..... 66/195; 66/196

(58) Field of Classification Search
CPC ..... D04B 21/16; D04B 21/14; D04B 21/20; D10B 2403/021; D10B 2403/022; D10B 2505/124
USPC ..... 66/195, 202, 196
See application file for complete search history.

(56) References Cited

U.S. PATENT DOCUMENTS

| | | | | | |
|---|---|---|---|---|---|
| 459,866 | A * | 9/1891 | Clewley | 66/170 |
| 4,787,219 | A * | 11/1988 | Sato et al. | 66/190 |
| 5,385,036 | A * | 1/1995 | Spillane et al. | 66/87 |
| 6,105,401 | A * | 8/2000 | Chadeyron et al. | 66/195 |
| 6,156,406 | A | 12/2000 | Rock et al. | |
| 6,199,410 | B1 * | 3/2001 | Rock et al. | 66/195 |
| 6,212,913 | B1 * | 4/2001 | Weiss | 66/172 R |
| 6,308,538 | B1 * | 10/2001 | Wood et al. | 66/170 |
| 6,644,070 | B2 * | 11/2003 | Ikenaga et al. | 66/196 |
| 6,755,052 | B1 * | 6/2004 | Sytz | 66/196 |
| 7,240,522 | B2 * | 7/2007 | Kondou et al. | 66/195 |
| 7,418,837 | B2 * | 9/2008 | Muller et al. | 66/195 |
| 7,779,654 | B2 * | 8/2010 | Garus | 66/195 |
| 7,913,520 | B1 * | 3/2011 | Chen et al. | 66/196 |
| 2004/0168479 | A1 * | 9/2004 | McMurray | 66/202 |

FOREIGN PATENT DOCUMENTS

| | | | |
|---|---|---|---|
| DE | 101 30 688 | A1 | 1/2003 |
| EP | 0 616 065 | A1 | 9/1994 |
| EP | 791306 | A1 * | 8/1997 |
| GB | 2 051 153 | A | 1/1981 |
| GB | 2080348 | A * | 2/1982 |

* cited by examiner

*Primary Examiner* — Danny Worrell
(74) *Attorney, Agent, or Firm* — Marshall & Melhom, LLC

(57) ABSTRACT

A knitted fabric is disclosed, comprising a first fabric layer, a second fabric layer and a plurality of pliable threads having a predetermined length, the respective ends of the pliable threads being stitched to the first and second layers thereby connecting the first and second layers. Preferably the fabric also contains sacrificial yarn to tie in the pliable threads. Also disclosed is a method for knitting a fabric according to the invention. The fabric has uses in inflatable devices, including airbags, or lifting devices.

23 Claims, 7 Drawing Sheets

| Stitches | Bar 1 | Bar 2 | Bar 3 | Bar 4 | Bar 5 | Bar 6 | Bar 7 |
|---|---|---|---|---|---|---|---|
| 1F | 1-0 | 1-0 | 1-1 | 13-13 | 1-0 | 1-1 | 2-2 |
| 2B | 2-2 | 0-0 | 1-1 | 2-1 | 0-0 | 1-0 | 3-4 |
| 3F | 3-4 | 0-1 | 1-2 | 1-1 | 0-1 | 0-0 | 2-2 |
| 4B | 2-2 | 1-1 | 2-2 | 1-2 | 1-1 | 0-1 | 1-0 |
| 5F | 1-0 | 1-0 | 2-1 | 2-2 | 1-0 | 1-1 | 2-2 |
| 6B | 2-2 | 0-0 | 1-1 | 2-1 | 0-0 | 1-0 | 3-4 |
| 7F | 3-4 | 0-1 | 1-2 | 1-1 | 0-1 | 0-0 | 2-2 |
| 8B | 2-2 | 1-1 | 2-2 | 1-2 | 1-1 | 0-1 | 1-0 |
| 9F | 1-0 | 1-0 | 2-1 | 2-2 | 1-0 | 1-1 | 2-2 |
| 10B | 2-2 | 0-0 | 1-1 | 2-1 | 0-0 | 1-0 | 3-4 |
| 11F | 3-4 | 0-1 | 1-2 | 1-1 | 0-1 | 0-0 | 2-2 |
| 12B | 2-2 | 1-1 | 7-7 | 1-1 | 1-1 | 0-1 | 1-0 |
| 13F | X 2 | X 2 | 13-13 | 13-13 | X 2 | X 2 | X 2 |
| 14B | | | 6-6 | 6-6 | | | |
| 15F | | | 0-0 | 0-0 | | | |
| 16B | | | 7-7 | 7-7 | | | |
| 17F | | | 13-13 | 13-13 | | | |
| 18B | | | 1-1 | 6-6 | | | |
| 19F | | | 1-1 | 2-1 | | | |
| 20B | | | 1-2 | 1-1 | | | |
| 21F | | | 2-2 | 1-2 | | | |
| 22B | | | 2-1 | 2-2 | | | |
| 23F | | | 1-1 | 2-1 | | | |
| 24B | | | 1-2 | 1-1 | | | |
| 25F | | | 2-2 | 1-2 | | | |
| 26B | | | 2-1 | 2-2 | | | |
| 27F | | | 1-1 | 2-1 | | | |
| 28B | | | 1-2 | 1-1 | | | |
| 29F | | | 13-13 | 1-1 | | | |
| 30B | | | 6-6 | 7-7 | | | |
| 31F | | | 0-0 | 13-13 | | | |
| 32B | | | 7-7 | 6-6 | | | |
| 33F | | | 13-13 | 0-0 | | | |
| 34B | | | 6-6 | 7-7 | | | |

NB. X2 = Repeat pattern twice

FIG. 1

KNITTED FABRIC

BACKGROUND OF THE INVENTION

This invention relates to knitted fabrics, to methods for manufacturing knitted fabrics and to devices comprising knitted fabrics.

Inflatable devices have uses in many areas of technology. Such uses include in protective devices such as airbags and in lifting devices. One problem associated with such devices is that the inflation should be controllable and that the device, when not inflated, should take up as little space as possible.

It is an aim of the present invention to provide an improved fabric which has a number of uses including in inflatable devices.

SUMMARY OF THE INVENTION

The present invention accordingly provides a knitted fabric comprising, a first (fabric) layer, a second (fabric) layer, and a plurality of pliable threads having a predetermined length, the respective ends of the pliable threads being stitched to the first and second (fabric) layers thereby connecting the first and second layers.

The advantage of this structure is that the plurality of pliable threads, having a predetermined length, provides a fabric in which the layers may be expanded in a controlled way e.g. by introducing fluid between the layers, yet, is relatively flat in the collapsed (i.e. un-expanded) state. The predetermined length of the pliable threads may be the same for all pliable threads or may differ for some pliable threads.

Preferably, the knitted fabric contains a sacrificial yarn. The sacrificial yarn preferably forms stitches which tie in at least some of the pliable threads. Use of a sacrificial yarn enables the predetermined length to be much greater than otherwise with the resulting advantage that the possible width of expansion of the layers of the fabric is also much greater. A further advantage is that the knitted fabric, with the pliable threads tied in between the layers, takes up little space and forms a more compact structure.

The sacrificial yarn preferably comprises a destructible yarn. The destructible yarn may be a soluble yarn (for example a water soluble yarn), an easily breakable yarn (for example a yarn having low strength, or a thin yarn) or a yarn with a low melting temperature. It is most preferred if the sacrificial yarn is a water soluble yarn such as polyvinyl alcohol.

The sacrificial yarn may be removed (e.g. if soluble) during or after the production process. Alternatively the sacrificial yarn (e.g. if easily breakable) may be retained until the fabric is e.g. expanded.

The fabric may comprise one or more yarns selected from polyester, polyamide, polypropylene, cotton, flax, hemp, silk, wool or aramid (ortho or para). The yarn or yarns used will depend upon the uses to which the fabric is to be put. So, for example, a fabric which requires some fire retardancy may incorporate some aramid yarn.

The predetermined length of the pliable threads may be 10 mm or greater, preferably 16 mm or greater, more preferably 24 mm or greater and most preferably 32 mm or greater, 36 mm or greater, 42 mm or greater, 50 mm or greater, 55 mm or greater, or 66 mm or greater. Generally, the predetermined length of the pliable threads will depend upon the use to which the fabric is to be put, since the predetermined length determines how far apart the layers may be expanded on inflation or otherwise. For airbag application especially in a garment, the predetermined length will generally be 1 to 15 cm, preferably 2 to 7 cm and most preferably about 3 to 6 cm. For lifting devices, the predetermined length will generally be 5 to 45 cm, more preferably 10 to 30 cm and most preferably 10 to 20 cm.

A great advantage of the structure of the present invention is that relatively long predetermined lengths may be used which enable the layer of the knitted fabric to expand widely.

Generally the knitted fabric of the present invention will have a density of about 100 to 2000 g/m$^2$. Each layer of the knitted fabric will generally have a density of about 50 to 1000 g/m$^2$, preferably 200 to 800 g/m$^2$, more preferably 300 to 700 g/m$^2$ and most preferably 400 to 600 g/m$^2$.

Typically, the fabric will comprise one or more yarns having a linear density of 80 to 500 decitex.

Preferably, the knitted fabric of the present invention will further comprise a film on at least one of the layers, preferably adhered to at least one layer. Preferably the film is a low permeability film, i.e. a film having low permeability to one or more fluids, in particular to air or water. The advantage of this is that inflation of the knitted fabric with a film is more easily achieved because the fluid used to inflate the knitted fabric will be retained more easily between the first and second layers. Preferably the film is substantially fluid impermeable e.g. an air impermeable film or water impermeable film.

The film may be attached or adhered to the layer by lamination or coating, i.e. may be a laminated or coated film. Lamination is usually preferred because it avoids difficulties of inconsistent coating performance which can occur if, for example, the two layers slide one on top of another during the coating process. However, for some applications coating may be used.

Preferably, the knitted fabric further comprises an adhesive film to improve the adhesion of the film to the layer.

In a preferred embodiment, both the first and second layers will have at least one film adhered or otherwise attached to them (optionally with an adhesive layer) so as to reduce the permeability of the knitted fabric still further.

The film may comprise polyurethane, polyvinyl acetate, polyethylene terephthalate, polyvinyl chloride, an acrylic polymer or a polyester. The more preferred films comprise polyurethane and/or polyvinyl chloride.

It is preferred if the pliable threads are formed of a multifilament yarn. This is advantageous because multifilament yarns may have the required pliability/flexibility so that the pliable threads, e.g. before expansion, can lie between the layers of the knitted fabric so that the fabric takes up the minimum space whilst in the collapsed state.

Preferably, the knitted fabric is a warp knitted fabric.

In a second aspect, the present invention provides a method for the manufacture of a knitted fabric, the method comprising, a) forming a first layer, b) forming a second layer, and c) connecting the first layer and the second layer with a plurality of pliable threads having a predetermined length by stitching the respective ends of the pliable threads to the first and second layers.

Preferably, the method uses a warp knitting machine, in particular a Raschel warp knitting machine.

Usually, the knitting machine used in the method will be a double needle bed machine.

The machine will generally have at least six guide bars, although seven or more guide bars can be used. Generally, two guide bars may be used for each of the layers of the knitted fabric with at least two guide bars preferably being used for forming the pliable threads. A seventh guide bar may be used to form the optional stitches using the sacrificial yarn, these stitches tie in at least some of the pliable threads.

Preferably, the guide bars of the machine are set so that the pliable threads tie in alternately on the first and second layers. This is advantageous because it means that the layers are connected relatively directly opposed to one another, reducing or preventing excess motion relative to one another (e.g. diagonal motion) when the fabric is expanded or inflated. It is preferred that the layers expand as close as possible to perpendicular.

The guide bar setting for the guide bar that inlays each of the pliable threads across needle for the desired number of stitches will generally depend upon the desired predetermined length of the pliable thread.

Whatever the method of manufacture of the knitted fabric, preferably after manufacture, the greige knitted fabric, is scoured. This preferably involves two stages: a first, wet stage where the fabric is wet tumbled and then a second hot scour and scrape stage to complete the cleaning of the fabric. If the knitted fabric comprises sacrificial yarn which is water soluble, the sacrificial yarn will be removed during the scouring process.

Following scouring, the fabric is preferably rinsed in water and then dried using a suction method. After this, preferably, the fabric is heat treated at above 160° C., preferably above 185° C. and most preferably at about 200° C. Different temperatures will, of course, be used depending upon the yarns used in the production of the knitted fabric. A temperature of about 200° C. is particularly suitable for polyester.

In a preferred embodiment of the present invention, after manufacture, one or both layers of the knitted fabric are coated or laminated. Lamination (e.g. adhering a pre-formed layer to the fabric) is generally preferred because it alleviates pinhole problems. Nevertheless, coating can, in some circumstances, be a useful method.

If lamination is used, then preferably a first, adhesive film is placed upon the second layer. The adhesive layer may comprise any adhesive film generally suitable for use in the textile industry. Suitable adhesive films include a fusible film comprising polyesters, polyurethanes, polyolefins and/or polyamides.

After application of the optional adhesive film, a lamination film is preferably applied to the first and/or second layer. Lamination often involves application of pressure and heat to adhere the lamination film strongly to the layer.

Typically the lamination film will have a thickness of between 10 and 300 μm. Generally, suitable lamination films include polymeric films comprising polyurethane, polyvinyl chloride, polyacrylic, polyethylene terephthalate, polyesters or polyamides. The preferred lamination film is a polyurethane.

The benefit of a lamination film is to provide a low permeability surface on the layer. This is greatly advantageous if the fabric is to be used in any application involving inflation.

In a third aspect, the present invention provides an inflatable device comprising the knitted fabric discussed above. The inflatable device may be incorporated in a personal airbag. Such personal airbags are of particular use for military or civilian applications including for motorcyclists, cyclists, and other participants in various sporting endeavours involving relatively high speed, including skiers, snowboarders and parachutists. Thus, in a fourth aspect the present invention provides a garment comprising an inflatable device as discussed above.

An alternative use of the knitted fabric discussed in this application is as a component in a lifting device. Thus, in a fifth aspect, the present invention provides a lifting device comprising an inflatable device as discussed above.

Finally, the present invention provides, in a sixth aspect, a knitted greige fabric containing sacrificial yarn.

BRIEF DESCRIPTION OF THE DRAWINGS

Embodiments of the present invention will now be described with reference to the accompanying drawings in which FIG. 1 contains a table with the pattern notation for a knitted fabric according to the invention.

DETAILED DESCRIPTION OF THE INVENTION

Figure 2:
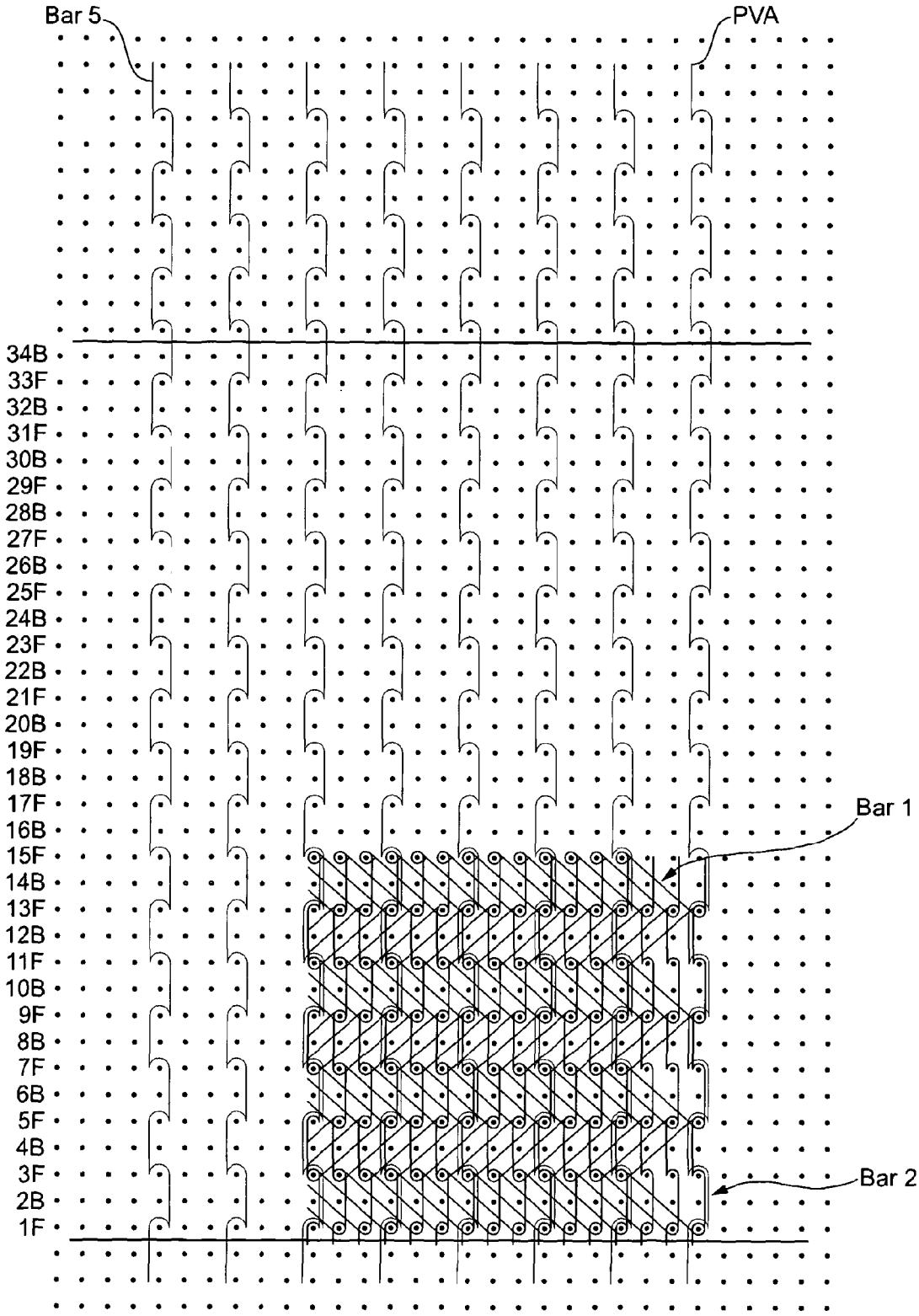
FIG. 2 illustrates, in schematic form, the pattern for a first layer of a knitted fabric according to the present invention using the notation in FIG. 1.
Figure 3:
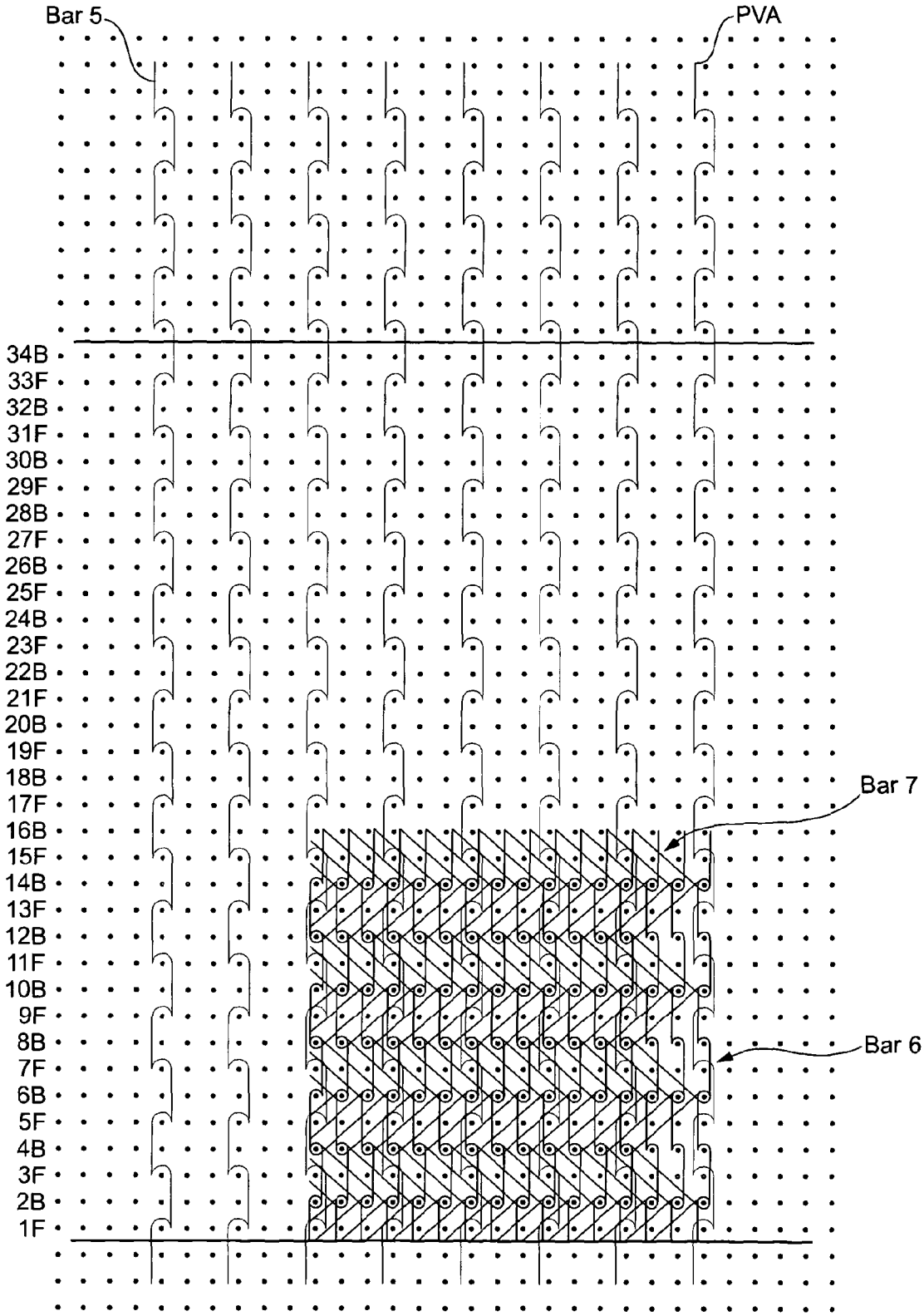
FIG. 3 illustrates, in schematic form, the pattern for a second layer of a knitted fabric according to the present invention using the notation in FIG. 1.
Figure 4:
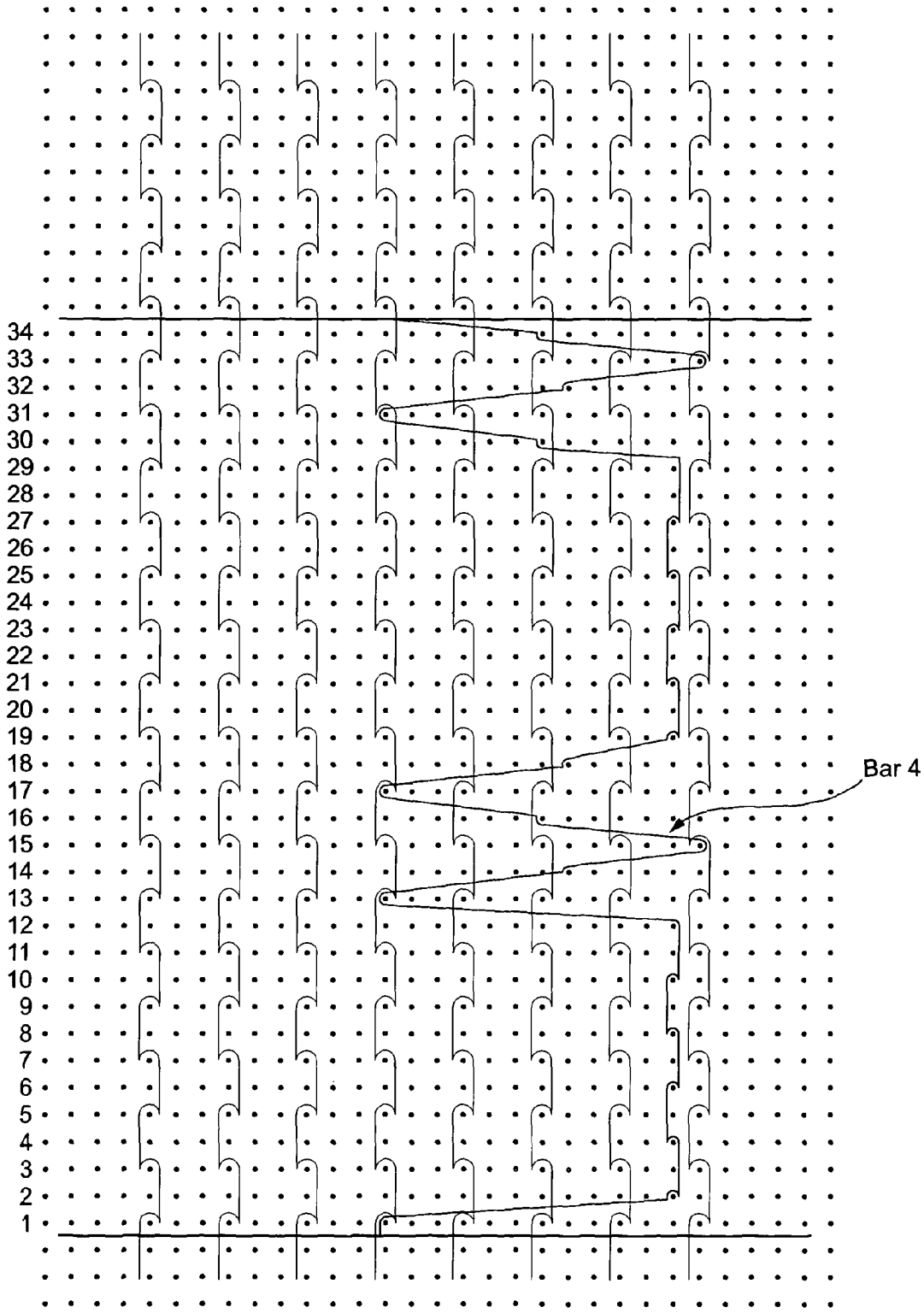
FIG. 4 illustrates, in schematic form, the pliable thread pattern for bar 4 of a knitted fabric according to the present invention using the notation in FIG. 1.
Figure 5:
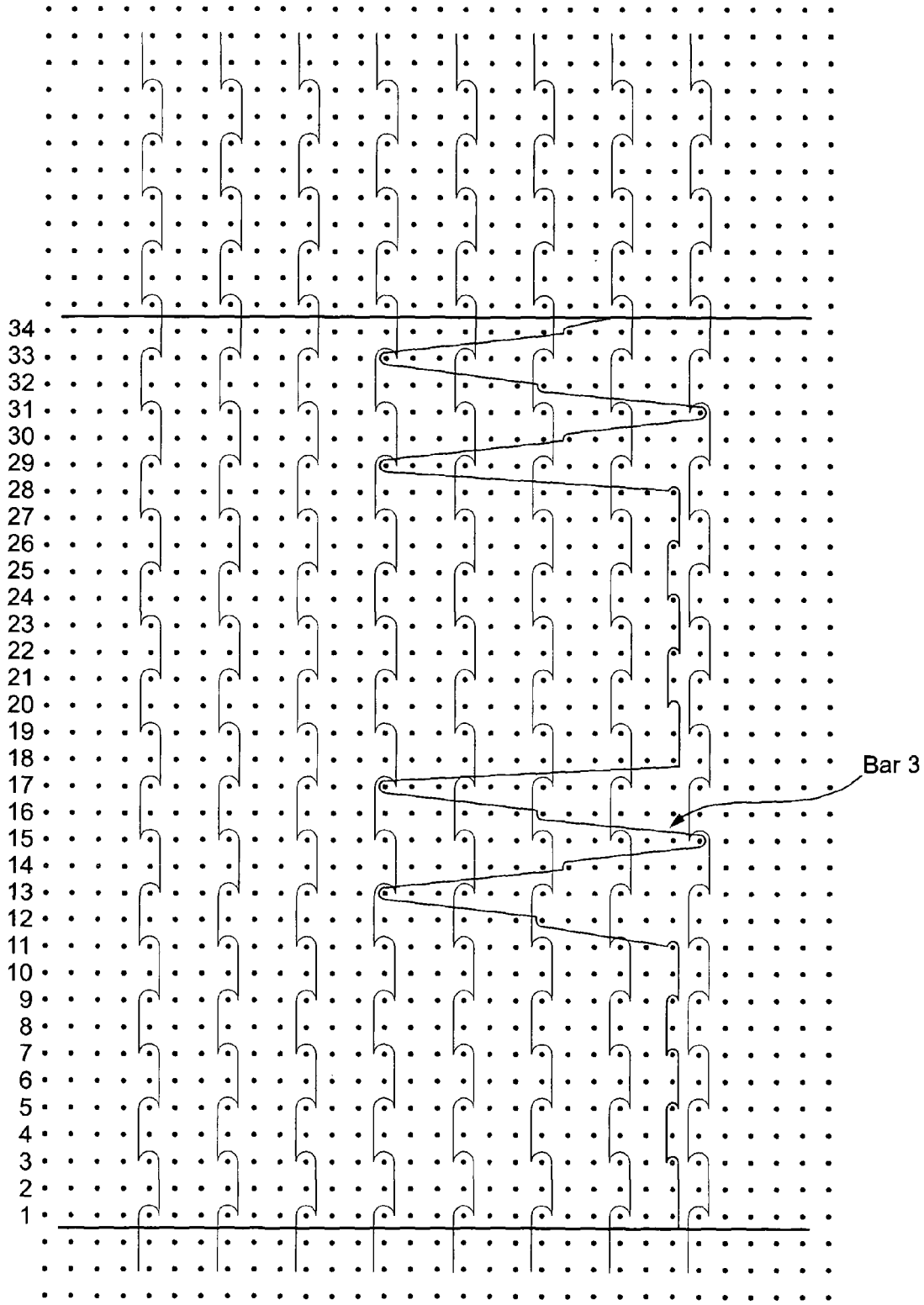
FIG. 5 illustrates, in schematic form, the pliable thread movement for bar 3 of a knitted fabric according to the present invention using the notation in FIG. 1.
Figure 6:
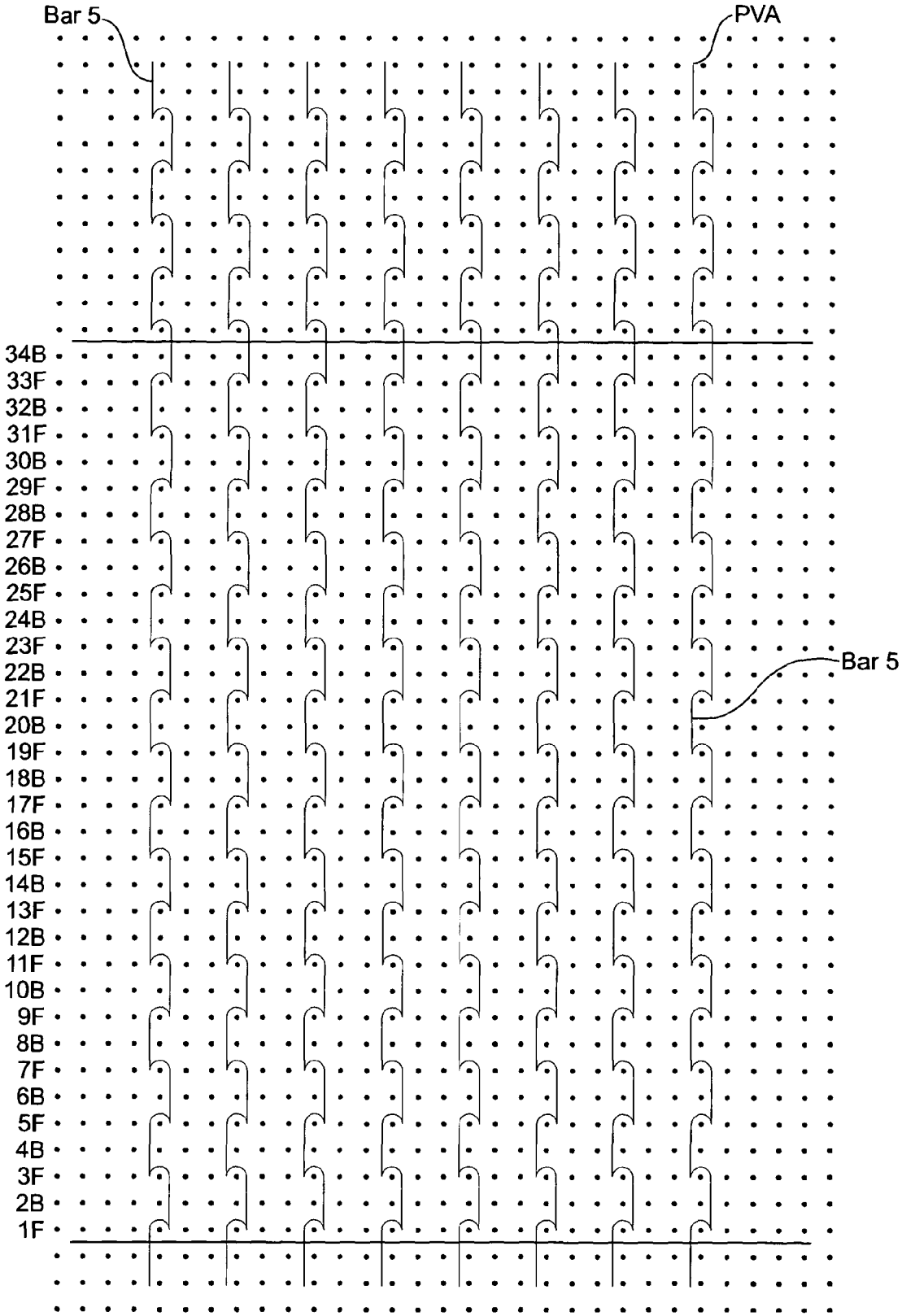
FIG. 6 illustrates, in schematic form, the sacrificial yarn movement for bar 5 of a knitted fabric according to the present invention using the notation in FIG. 1.
Figure 7:
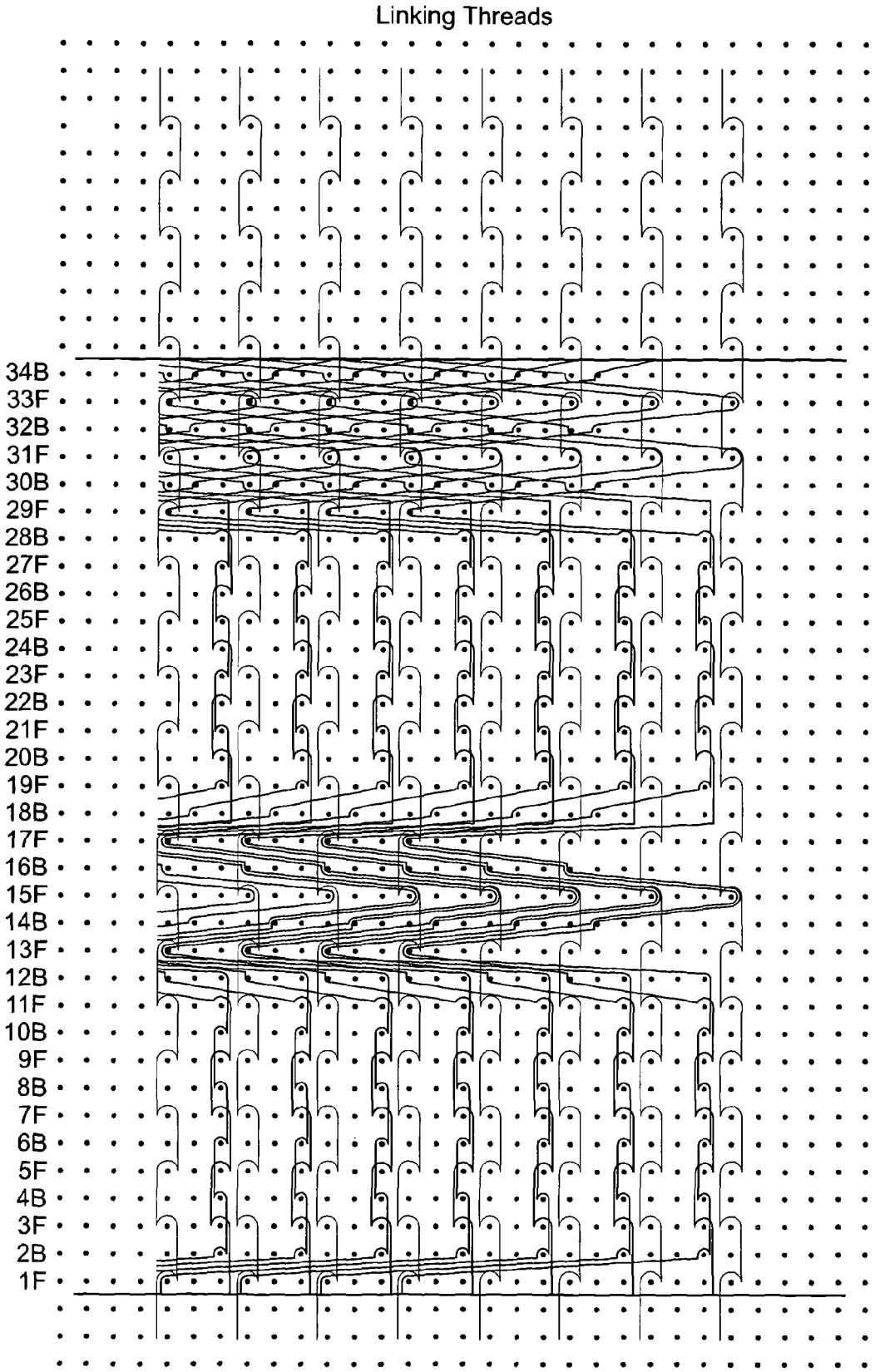
FIG. 7 illustrates in schematic form, the pliable thread movement for bar 3 and 4 of a knitted fabric according to the present invention using the notation in FIG. 1.

A knitted fabric according to the invention and having the pattern notation listed in the table in FIG. 1, may be produced using a 7 guide bar double needle bed machine (Karl Mayer, Liba or similar).

As would be known to those skilled in the art, the pattern is first put on the machine, by grinding the links which move each guide bar the required amount of needles. The links are ground so the wheel that follows the profile of the links has a smooth movement from large to small link.

When the pattern of all 7 bars has been made this would be placed on the pattern drum. The guide bars are then placed on the machine one at a time to ensure that all the overlap and inlay movements are correct. The depth of the guide on each guide bar should be sufficient for all of the threads in that guide bar, when threaded, to provide a filament free overlap and underlap.

Before threading, the correct gearing is set on the machine and provides the required courses per inch.

Threading of the machine is as follows (assuming 22 gauge and 77 inch wide machine):

Guide Bar 1 has a thread in every guide, 1694 threads required.

Guide Bar 2 s Bar 1, 1694 threads required.

Guide bar 3 requires fewer threads as the threading is 1 thread in miss 2 guides so this bar requires 564 threads in total.

Guide Bar 4 has the same as bar 3, 564 threads.

Guide 5 has the same as bar 3, 564 threads.

Guide Bar 6 this is the same as bar 1 a thread in every guide=1694 threads.

Guide Bar 7 has the same as bars 1, 2 and 6, 1694 threads.

A knitted fabric according to the invention and produced as described above forms a compact two layer greige fabric with the layers tightly tied in together by the (sacrificial) PVA yarn and the long, pliable threads tied in between the layers. Washing of the fabric in water (which may be conveniently achieved during the usual scouring and washing process) results in the PVA yarn dissolving and the layers being able to separate or expand to the distance determined by the length of the pliable threads.

The invention claimed is:

1. A knitted fabric comprising, a first layer, a second layer, a plurality of pliable threads formed of a multi-filament yarn, each pliable thread having at least one portion of a predetermined length, opposing ends of each portion of the plurality of pliable threads being stitched respectively to the first and second layers thereby connecting the first and second layers, and a sacrificial yarn inlaying at least some of the plurality of pliable thread portions between their opposing ends with one or both of said first and second layers such that the first and second layers are separable a distance corresponding to a distance between a first inlay of a pliable thread portion and either an end of said pliable thread portion or a second inlay, wherein with the inlay by the sacrificial yarn removed, the first and second layers are separable from one another the predetermined lengths of said plurality of pliable thread portions.

2. The knitted fabric as claimed in claim 1, wherein the sacrificial yarn comprises a destructible yarn selected from the group consisting of a soluble yarn, an easily breakable yarn, and a yarn with a low melting temperature.

3. The knitted fabric as claimed in claim 1, wherein the sacrificial yarn comprises polyvinyl alcohol.

4. The knitted fabric as claimed in claim 1, wherein the fabric comprises one or more yarns selected from the group consisting of polyester, polyamide, polypropylene, flax, hemp, cotton, silk, wool and aramid.

5. The knitted fabric as claimed in claim 1, wherein the predetermined length is 10 mm or greater.

6. The knitted fabric as claimed in claim 1, wherein the knitted fabric has a density of 100 to 2000 g/m$^2$.

7. The knitted fabric as claimed in claim 1, wherein the fabric comprises one or more yarns having a linear mass density of 80 to 500 decitex.

8. The knitted fabric as claimed in claim 1, further comprising a film on at least one of the first and second layers.

9. The knitted fabric as claimed in claim 8, wherein the film is a laminated or a coated film.

10. The knitted fabric as claimed in claim 8, wherein the film is a low permeability film.

11. The knitted fabric as claimed in claim 8, further comprising an adhesive film to improve the adhesion of film to one or both of the first and second layers.

12. The knitted fabric as claimed in claim 8, wherein the film comprises polyurethane, polyvinyl acetate, polyethylene terephthalate, an acrylic polymer or a polyester.

13. The knitted fabric as claimed in claim 1, wherein the knitted fabric is a warp knitted fabric.

14. A method for the manufacture of a knitted fabric, the method comprising, a) forming a first layer, b) forming a second layer, c) connecting the first layer and the second layer with a plurality of pliable threads formed of a multi-filament yarn, each pliable thread having at least one portion of a predetermined length, opposing ends of each portion of the plurality of pliable threads being stitched respectively to the first and second layers thereby connecting the first and second layers, and d) using a sacrificial yarn to inlay at least some of the plurality of pliable thread portions between their opposing ends with one or both of said first and second layers such that the first and second layers are separable a distance corresponding to a distance between a first inlay of a pliable thread portion and either an end of said pliable thread portion or a second inlay, said distance being less than the predetermined length of the pliable thread portion.

15. An inflatable device comprising a knitted fabric of claim 1.

16. An inflatable device as claimed in claim 15, wherein the device acts as a personal air bag.

17. A garment comprising an inflatable device as claimed in claim 15.

18. A lifting device comprising an inflatable device as claimed in claim 15.

19. A knitted greige fabric comprising a knitted fabric as claimed in claim 1.

20. The knitted fabric as claimed in claim 1, wherein the predetermined length is 16 mm or greater.

21. The knitted fabric as claimed in claim 1, wherein the predetermined length is 24 mm or greater.

22. The knitted fabric as claimed in claim 1, wherein the predetermined length is 66 mm or greater.

23. The method as claimed in claim 14, further comprising, subsequently removing the inlay by the sacrificial yarn whereby the first and second layers are separable from one another by the predetermined lengths of said plurality of pliable thread portions.

* * * * *